United States Patent [19]

Neubauer

[11] Patent Number: 4,842,486

[45] Date of Patent: Jun. 27, 1989

[54] METHOD AND APPARATUS FOR INCREASING THE OPERATING EFFICIENCY OF A LIQUID-FLOW MACHINE

[75] Inventor: Hans R. Neubauer, Weisendorf, Fed. Rep. of Germany

[73] Assignee: Siemens Aktiengesellschaft, Munich, Fed. Rep. of Germany

[21] Appl. No.: 924,678

[22] Filed: Oct. 29, 1986

[30] Foreign Application Priority Data

Dec. 19, 1985 [DE] Fed. Rep. of Germany ..... 3545101

[51] Int. Cl.[4] ..... F04C 19/00

[52] U.S. Cl. ..... 417/53; 137/13; 417/68

[58] Field of Search ..... 417/53, 68, 69, 313; 137/13

[56] References Cited

U.S. PATENT DOCUMENTS

| | | | |
|---|---|---|---|
| 2,042,991 | 6/1936 | Harris, Jr. | 417/53 |
| 3,720,216 | 3/1973 | Wartman et al. | 137/13 |
| 3,862,077 | 1/1975 | Schulz et al. | 525/404 X |
| 4,016,894 | 4/1977 | Baldwin et al. | 137/13 |
| 4,263,927 | 4/1981 | Wilski et al. | 137/13 |
| 4,397,748 | 8/1983 | Argabright et al. | 137/13 |
| 4,650,493 | 3/1987 | Pahlsson et al. | 252/174.21 X |

FOREIGN PATENT DOCUMENTS

| | | | |
|---|---|---|---|
| 212383 | 12/1982 | Japan | 417/53 |
| 687258 | 9/1979 | U.S.S.R. | 417/68 |
| 1154490 | 5/1985 | U.S.S.R. | 417/68 |

*Primary Examiner*—Leonard E. Smith

*Attorney, Agent, or Firm*—Kenyon & Kenyon

[57] ABSTRACT

An apparatus for improving the operating efficiency of a liquid-flow machine comprises a sensor for measuring the liquid throughput of the liquid-flow machine and a dosing device for controlling, in response to the measured throughput, the amount of a friction-reducing agent added to inflowing working fluid. The friction reducing agent preferably consists of marcomolecular bodies such as polyacrylamides or tensides. Inorganic fiber is also possible as an additive for reducing friction in the liquid-flow machine.

21 Claims, 1 Drawing Sheet

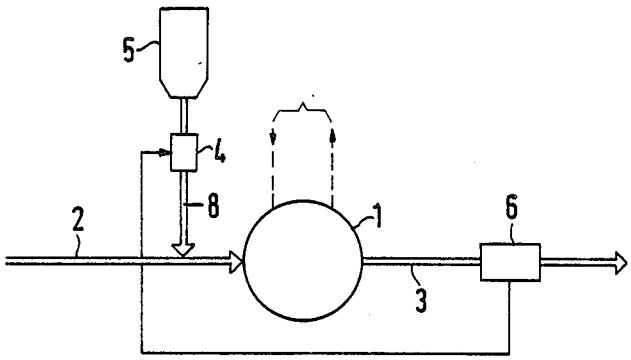
5
4
8
2
1
6
3

METHOD AND APPARATUS FOR INCREASING THE OPERATING EFFICIENCY OF A LIQUID-FLOW MACHINE

BACKGROUND OF THE INVENTION

This invention relates in general to a liquid-flow machine. More particularly, this invention relates to a method and apparatus for increasing the operating efficiency of such a machine.

To increase the amount of liquid conveyed per unit time in known liquid-flow machines and to improve the efficiency of such machines, i.e., to minimize operating losses, machine contours in contact with the liquid stream have been modified in an attempt to produce flow patterns as free of turbulence within the machines as possible. In addition, the contact surfaces have been ground as smooth as possible for increasing the operating pressure of the machines. A reduction of sound emission through the machine housings to the outside has been effectuated by separate sound insulation.

Such measures are not only costly but can be improved by further techniques, if at all, only to a relatively small degree.

An object of the present invention is to provide an improved liquid-flow machine.

Another, concomitant, object of the present invention is to provide a method and an associated apparatus for increasing the operating efficiency of a liquid-flow machine.

Another object of the present invention is to provide such a method and apparatus which achieve better operation without special design measures for all possible kinds and types of liquid-flow machines.

Another, more particular, object of the present invention is to provide such a machine, such a method and such an apparatus in which conveyed liquid flow can be increased considerably with reduced driving power.

Another particular object of the present invention is to provide such a machine, such a method, and such a apparatus in which an increase in the operating pressure can be achieved while reducing driving power.

Yet another particular object of the present invention is to provide such a machine, such a method and such an apparatus wherein sound emission from the liquid-flow machine can be reduced.

SUMMARY OF THE INVENTION

A method for increasing the operating efficiency of a liquid-flow machine comprises, in accordance with the present invention, the steps of: (a) feeding a working fluid to an input of the machine, (b) adding to the working fluid, at a point upstream of an input, a substantially controlled number of macromolecular bodies acting as friction reducing agents, and (c) operating the machine with the working fluid including the macromolecular bodies.

An apparatus for increasing the operating efficiency of a liquid flow machine having an input connected to an inflow line for receiving a working fluid comprises, in accordance with the present invention, a friction reducing device connectable to the inflow line for adding to the working fluid, at a point upstream of the input of the liquid-flow machine, a substantially controlled number of macromolecular bodies acting as friction reducing agents. Advantageously, a sensor or detector is operably couplable to the machine for measuring the rate of flow of the working fluid through the machine.

A control unit is operatively connected to the friction reducing device and to the sensor or detector for controlling, in response to the throughput of the working fluid measured by the detector, the rate that the macromolecular bodies are added to the working fluid by the friction reducing device.

Accordingly, a liquid-flow machine in accordance with the present invention comprises: (a) a working unit utilizing a working fluid, (b) an inflow line connected to an input of the working unit for delivering the working fluid thereto, and (c) a friction reducing device connected to the inflow line for adding to the working fluid, at a point upstream of the input of the working unit, a substantially controlled number of macromolecular bodies acting as friction reducing agents. The liquid-flow machine advantageously further comprises a detector coupled to the working unit for measuring the rate of flow of the working fluid through the machine and a control unit operatively connected to the friction reducing device and to the detector for controlling, in response to the throughput of the working fluid measured by the detector, the rate that the macromolecular bodies are added to the working fluid by the friction reducing device.

The macromolecular substances introduced into the working fluid upstream of the input to the working unit of the liquid-flow machine are advantageously polymers, particularly polyacrylamides, or tensides, or inorganic fibers. The macromolecular bodies can take the form of a powder or a liquid solution. As set forth above, the macromolecular bodies are injected into or added to the flowing working fluid in a quantity matched to the mass throughput of the working liquid, whereby a steady supply of the friction reducing agents or flow accelerators is provided to the working fluid entering the working unit of the liquid-flow machine.

The quantity of the friction reducing agents, i.e., the macromolecular bodies, is relatively small in comparison with the quantity of the inflowing working fluid and, accordingly, the consumption of the macromolecular bodies, in a method in accordance with the present invention, is small during operation of the liquid-flow machine.

A method in accordance with the present invention is particularly well adapted for liquid-ring machines wherein a vane wheel drives a liquid ring in a housing. In the circulating operation of such machines, working liquid is returned to the machine from a liquid separator disposed downstream of a gas outlet. The amount of liquid required for replacing the lost liquid is small and the amount of friction reducing agent required is even smaller.

Tests with a liquid-ring vacuum pump, Siemens type 2BE 1, 2 or 3, have shown that the use of polyacrylamide of different concentrations (50 ppm and 96 ppm) in the working liquid results in an increase in output of approximately 10% or more as a function of the suction pressure, particularly in the operating range of interest. In addition, the power requirements can likewise be lowered by approximately 10% or more, while a greater reduction of sound level can be achieved.

BRIEF DESCRIPTION OF THE DRAWING

The sole FIGURE of the drawing is a diagram of a liquid-flow machine including an apparatus in accordance with the present invention for increasing the operating efficiency of the liquid-flow machine.

DETAILED DESCRIPTION

As illustrated in the drawing, a liquid pump 1 is connected at an input to an inflow line 2 and at an output to a discharge line 3. Working fluid is conveyed to liquid pump 1 via inflow line 2 and flows out from the pump via discharge line 3. To input line 2 is connected a supply tank or reservoir 5 containing a powder or liquid solution of friction reducing agents, preferably organic macromolecular bodies such as polyacrylamides or tensides.

A dosing device 4 for controlling the number of friction reducing agents injected or added to the working fluid in inflow line 2 is disposed in a delivery line 8 extending from supply tank 5 to inflow line 2. The rate at which macromolecular bodies are added to the inflowing working fluid in varied by dosing device 4 in response to signals from a sensor or detector 6 disposed in discharge line 3 for measuring the mass throughput of the working fluid through liquid pump 1. Dosing device 4 and detector 6 cooperate to ensure that the friction reducing macromolecular bodies are released into the inflowing working fluid at such a rate that the inflowing fluid has a constant percentage of the macromolecular bodies per unit volume. In this manner, the suction power reduction caused by the temperature rise of the working fluid per se can be more than compensated.

Although the invention has been described in terms of particular embodiments and modifications, one of ordinary skill in the ar in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. An apparatus for increasing the operating efficiency of a liquid-flow machine, said liquid-flow machine having an input connected to an inflow line for receiving a working fluid therefrom, said apparatus comprising:

first means connectable to said inflow line for adding to the working fluid, at a point upstream of said input, a substantially controlled number of macromolecular bodies acting as friction reducing agents;

second means operatively couplable to said machine for measuring throughput of said working fluid through said machine; and third means operatively connected to said first means and to said second means for controlling, in response to the throughput of said working fluid measured by said second means, the rate that said macromolecular bodies are added to said working fluid by said first means.

2. A method for increasing the operating efficiency of a liquid-flow machine having a means for driving a liquid ring in a housing to transport a gas, comprising the steps of:

feeding a working fluid to an input of said machine;

adding to the working fluid, at a point upstream of said input, a substantially controlled number of macromolecular bodies acting as friction reducing agents;

operating said machine with said working fluid including said macromolecular bodies to transport said gas through a gas outlet;

separating said working fluid from said gas downstream of said gas outlet; and recirculating substantially all of said working fluid, including said macromoleuclar bodies, to said input.

3. The method defined in claim 2 wherein said macromolecular bodies are polyacrylamide bodies.

4. The method defined in claim 2 wherein said macromolecular bodies are tenside bodies.

5. A liquid-flow machine, comprising:

a working unit, having a means for driving a liquid ring to transport a gas through a gas outlet, utilizing a working fluid, said working unit having an input and an output;

first means including an inflow line connected to said input for delivering said working fluid to said working unit;

second means connected to said inflow line for adding to said working fluid, at a point upstream of said input, a substantially controlled number of macromolecular bodies acting as friction reducing agents;

third means for separating said working fluid from said gas downstream of said gas outlet; and fourth means connected to said input and to said third means for recirculating from said third means to said input substantially all of said working fluid, including said macromolecular bodies.

6. The machine defined in claim 5 wherein said macromolecular bodies are polyacrylamide bodies.

7. The machine defined in claim 5 wherein said macromolecular bodies are tenside bodies.

8. A method for increasing the operating efficiency of a liquid-flow machine, comprising the steps of:

feeding a working fluid to an input of said machine;

adding to the working fluid, at a point upstream of said input and at a rate proportional to a mass flow rate of said working fluid to said input, a substantially controlled number of macromolecular bodies acting as friction reducing agents; and operating said machine with said working fluid including said macromolecular bodies.

9. The method defined in claim 1 wherein said macromolecular bodies are added to said working fluid in powder form.

10. The method defined in claim 1 wherein said macromolecular bodies are added to said working fluid in a liquid solution.

11. The method defined in claim 1 wherein said macromolecular bodies are tensile bodies.

12. The method defined in claim 1, further comprising the step of measuring said mass flow rate prior to said step of feeding.

13. The method defined in claim 12, wherein said step of measuring is performed continuously during operation of said machine.

14. The method defined in claim 1 wherein said macromolecular bodies are organic.

15. The method defined in claim 14 wherein said macromolecular bodies are polyacrylamide bodies.

16. A liquid-flow machine comprising:

a working unit utilizing a working fluid, said working unit having an input and an output;

first means including an inflow line connected to said input for delivery said working fluid to said working unit;

second means connected to said inflow line for adding to said working fluid, at a point upstream of said input, a substantially controlled number of macromolecular bodies acting as friction reducing agents;

third means operatively coupled to said working unit for measuring throughput of said working fluid through said machine; and fourth means operatively connected to said second means and to said third means for controlling, in response to the throughput of said working fluid measured by said third means, the rate that said macromolecular bodies are added to said working fluid by said second means.

17. The machine defined in claim 16, further comprising an outflow line connected to said output, said third means including a flow-rate sensor disposed in said outflow line.

18. The machine defined in claim 16 wherein said second means includes a reservoir for storing a supply of said macromolecular bodies and further includes a delivery line extending to said input line, said fourth means including a dosing device inserted in said delivery line.

19. The machine defined in claim 16 wherein said macromolecular bodies are added to said working fluid in powder form.

20. The machine defined in claim 16 wherein said macromolecular bodies are added to said working fluid in a liquid solution.

21. The machine defined in claim 16 wherein said macromolecular bodies are organic.

* * * * *